US008601739B2

(12) United States Patent
Deitchman

(10) Patent No.: US 8,601,739 B2
(45) Date of Patent: Dec. 10, 2013

(54) GATE ARM SAVER

(75) Inventor: Jerry C. Deitchman, Louisville, KY (US)

(73) Assignee: Siemens Rail Automation Corporation, Louisville, KY (US)

( * ) Notice: Subject to any disclaimer, the term of this patent is extended or adjusted under 35 U.S.C. 154(b) by 19 days.

(21) Appl. No.: 13/225,169

(22) Filed: Sep. 2, 2011

(65) Prior Publication Data

US 2013/0055640 A1 Mar. 7, 2013

(51) Int. Cl.
*B61L 29/04* (2006.01)

(52) U.S. Cl.
USPC ..... 49/9; 49/49

(58) Field of Classification Search
USPC ..... 49/9, 49, 141; 404/10; 105/341
See application file for complete search history.

(56) References Cited

U.S. PATENT DOCUMENTS

| | | | | | |
|---|---|---|---|---|---|
| 1,356,302 | A | * | 10/1920 | Mills | 49/141 |
| 1,382,534 | A | * | 6/1921 | Oelenschlager et al. | 49/247 |
| 3,394,498 | A | * | 7/1968 | Reinitz et al. | 49/141 |
| 4,057,208 | A | * | 11/1977 | Andrews et al. | 246/125 |
| 4,124,955 | A | * | 11/1978 | Kochis | 49/237 |
| 4,227,344 | A | * | 10/1980 | Poppke | 49/9 |
| 4,364,200 | A | * | 12/1982 | Cobb | 49/192 |
| 4,897,960 | A | * | 2/1990 | Barvinek et al. | 49/49 |
| 5,904,115 | A | * | 5/1999 | Durbin et al. | 116/28 R |
| 6,470,626 | B2 | * | 10/2002 | Luetzow et al. | 49/9 |
| 6,672,008 | B1 | * | 1/2004 | Luetzow et al. | 49/9 |
| 6,813,860 | B2 | * | 11/2004 | Burnette et al. | 49/49 |
| 6,966,146 | B2 | * | 11/2005 | Pease | 49/49 |
| 7,296,608 | B2 | * | 11/2007 | Weishar et al. | 160/200 |
| 7,818,920 | B2 | * | 10/2010 | Causey et al. | 49/49 |
| 8,161,681 | B2 | * | 4/2012 | Treihaft | 49/49 |
| 8,181,392 | B1 | * | 5/2012 | Farber | 49/49 |
| 8,240,618 | B1 | * | 8/2012 | Luetzow | 246/111 |
| 8,322,080 | B2 | * | 12/2012 | Treihaft | 49/506 |
| 2002/0134020 | A1 | * | 9/2002 | Luetzow et al. | 49/9 |
| 2004/0182005 | A1 | * | 9/2004 | Basio | 49/49 |
| 2010/0275515 | A1 | * | 11/2010 | Gelfand et al. | 49/9 |
| 2011/0113690 | A1 | * | 5/2011 | Luetzow et al. | 49/49 |

OTHER PUBLICATIONS

National Electric Gate Company, Gate Arms; website http://www.nationalelectricgate.com/BCGateSaver.php ; known prior to Sep. 2, 2011; 14 page.

* cited by examiner

*Primary Examiner* — Katerine Mitchell
*Assistant Examiner* — Justin Rephann

(57) ABSTRACT

A gate arm saver is provided. The gate arm saver includes a cam and cam follower arrangement. A biasing element biases the cam follower into engagement with a detent formed in the cam upon rotation of the cam from a rest position due a loading placed upon a gate arm extending from the gate arm saver.

12 Claims, 2 Drawing Sheets

GATE ARM SAVER

FIELD OF THE INVENTION

This invention generally relates to rail road safety technology and more particularly, but not exclusively, to railroad safety devices for use in a rail road system at a level crossing.

BACKGROUND OF THE INVENTION

Road traffic is prevented from crossing a rail road by a barrier or gate arm. The gate arm is lowered from a raised to a substantially horizontal position to present a physical barrier.

On occasions gate-arms are damaged when vehicles collide with them. This causes damage to the gate arm and its pivot mechanism. To alleviate this problem so-called gate savers are available. These allow the gate arm to pivot in a horizontal plane. In order to restore the gate arm to its original position it is known to provide hydraulic pistons or compression springs. The arrangements are complicated, only permit a small range of movement and may be subject to failure as it will be appreciated that gate-arms are located in the open and thus exposed to the effects of the weather.

In addition some prior art arrangements require the spring to be unloaded to allow re-positioning of the gate arm after impact. It will be recognized that such unloading is an additional step that can require additional resources to accomplish. In remote areas, it can take some time for these resources to arrive to conduct these resetting operations. Accordingly, there is a need in the art for a gate arm saver that presents a less complicated, more cost effective, broader range of motion solution that automatically resets itself after an impact.

The invention provides such a gate arm saver. These and other advantages of the invention, as well as additional inventive features, will be apparent from the description of the invention provided herein.

BRIEF SUMMARY OF THE INVENTION

According to the invention there is provided a gate arm saver comprising a mounting bracket to which in use a gate arm is fixed, a pivot about which the gate arm is pivotably mounted, a cam positioned outwardly about the pivot, a cam follower abutting the cam, a leaf spring for resiliently urging the cam follower into engagement with the cam and a detent provided in the cam corresponding to a rest position for the arm such that force applied about the pivot overcomes the spring bias provided by the leaf spring to force the cam follower out of engagement with the detent and relative movement of the cam and cam follower to permit movement of the gate arm.

Preferably the detent is provided by a notch in the profile of the cam.

It has been found that the provision of a detent, in the form of a notch and cam, allows the setting of the force threshold to be overcome by simply varying the depth of the notch. The notch may be easily machined into the profile of the cam. The opening motion of the arm may also be controlled at least in part by the profile of the cam and or the profile of the notch.

Significant advantages may result from embodiments of the invention. The use of the leaf spring makes the design less expensive than current arm savers and the design is less susceptible to vandalism as it has fewer moving parts and is more robust. The design will also avoid the need for complicated loading arrangements used in current arm savers and makes the design safer to install and maintain.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
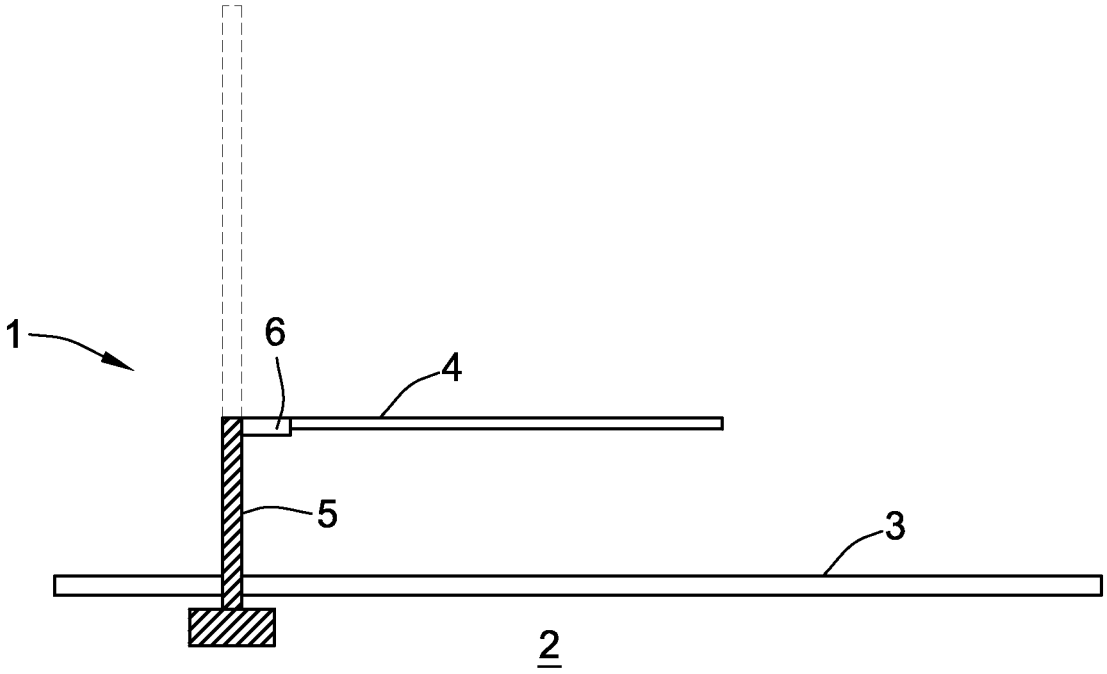
FIG. 1 is a front view of an embodiment of a gate arm saver and a rail road gate in accordance with the teachings of the present invention.

As is shown in FIG. 1, a rail road gate 1 is positioned at an approach 2 to a rail road crossing point 3. The gate 1 includes a gate arm 4 which may be lowered from a vertical position (shown in broken outline) to a horizontal deployed position. In the deployed position, the arm 4 forms a barrier to prevent road traffic crossing the rail road.

Figure 2:
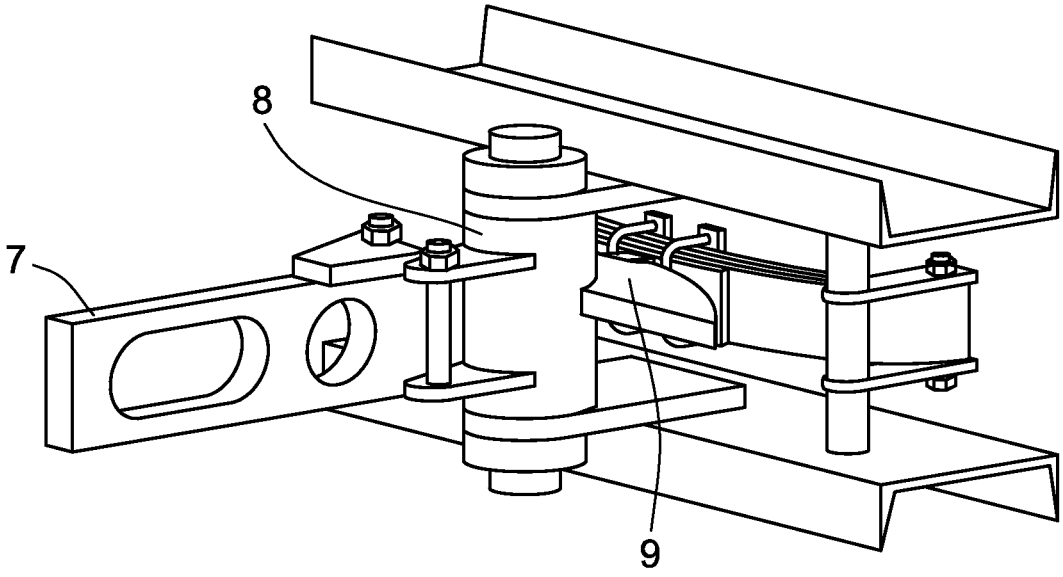
FIG. 2 is a perspective view of the gate arm saver of FIG. 1 with the gate arm removed.

The gate arm 4 is connected to a lifting device 5 by a gate saver 6. The gate saver 6 is shown in greater detail in FIG. 2 with the gate arm removed. The gate arm fits over a gate arm mounting bracket 7. The gate arm mounting bracket is connected to a pivot 8 that defines a pivot axis 20 and about which is fixed a cam 9.

Figure 3:
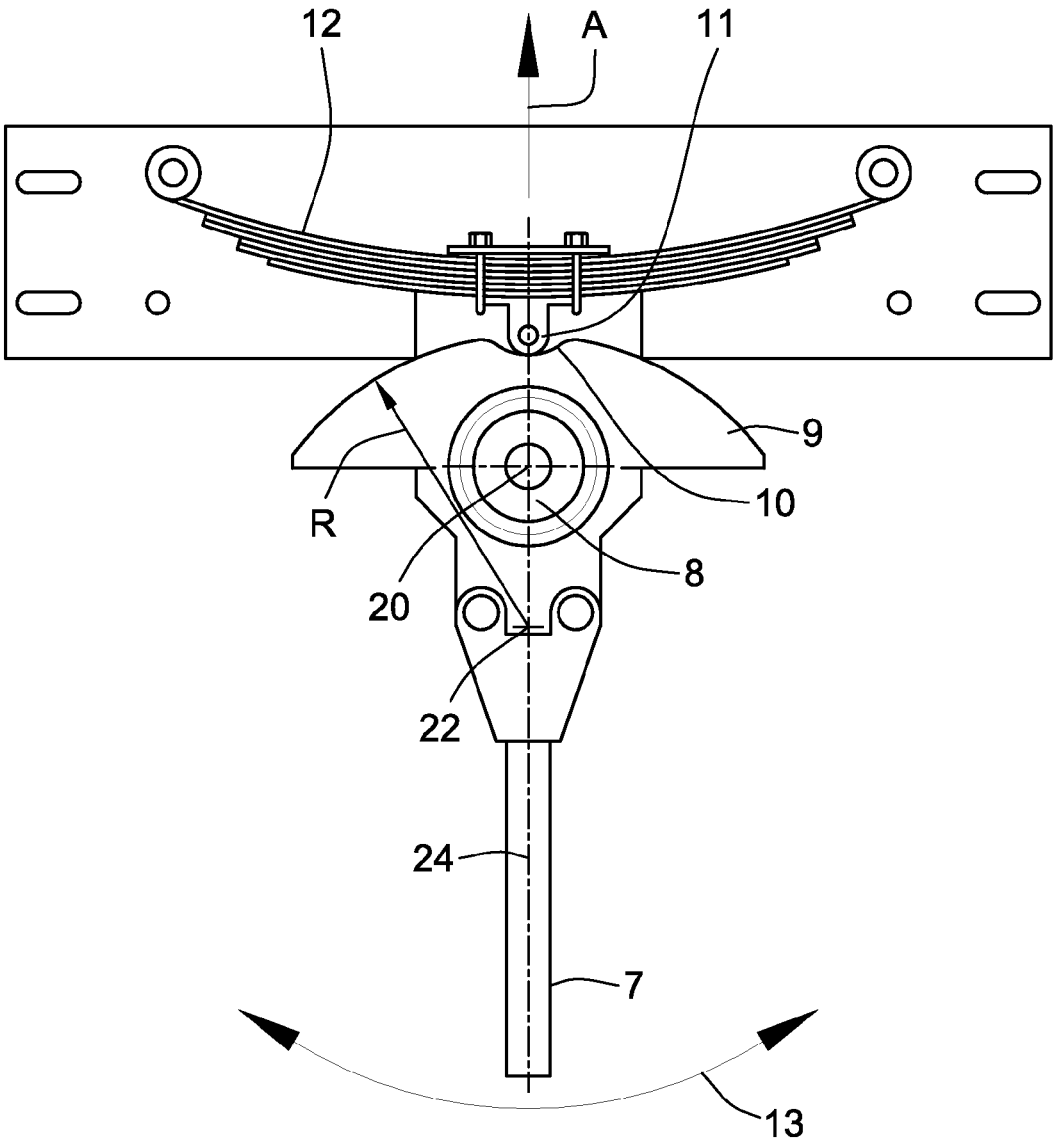
FIG. 3 is a plan view of the gate arm saver showing a leaf spring, cam, and cam follower of the gate arm saver of FIG. 1.

As is more clearly shown in FIG. 3, the cam 9 is generally arcuate in plan with a radius of curvature R having an origin 22 with a semi-circular notch 10 at its apex. Within the notch 10 is located a cam follower 11. The cam follower 11 is urged into engagement with the notch 10 by a leaf-spring 12. The notch 10 thus provides a detent or rest position for the arrangement. The notch 10, cam follower11 and axis 20 are alined along a common axis 24 in the rest position. Although illustrated as a generally arcuate notch and cam follower arrangement, it will be recognized that the notch 10 and follower 11 can take on various over shapes and are not limited to the illustrated embodiment. Indeed, the follower 11 and notch 10 can take on any generally mating relationship that will allow for the operation of the gate arm saver 6 as described herein.

In use, if a vehicle impacts the arm 4 it will push the arm in the horizontal plane. This will force the notch 10 of the cam 9 against the cam follower 11. The resultant relative movement will cause the notch 10 to push the cam follower 11 against the spring bias provided by the leaf spring 12 in the direction of arrow 13. The cam 9 will then pass under the cam follower 11 permitting the arm 7 to move in the horizontal plane in the direction of motion of the vehicle as represented by arrow 13 about the pivot 8. This prevents damage that would otherwise be caused by the impact.

Removal of the vehicle will allow the gate arm 4 to move back to the detent position under the action of the leaf spring 12. Put differently, the leaf spring 12 presents a compact biasing element for providing a sufficient biasing force for automatically restoring the follower 11 into the notch 10 of the cam 9. As a result, down time of a rail road crossing employing such a device is significantly reduced. Further, due to the use of a leaf spring 12 which has proven its ability to withstand the elements, the likelihood of the gate saver 6 failing due to harsh weather conditions over time is significantly reduced.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A gate arm saver, comprising:

a mounting bracket configured to receive a gate arm, a pivot about which the mounting bracket is pivotably mounted;

a cam positioned outwardly about the pivot, the cam including a detent, the cam pivotable about the pivot from a rest position;

a cam follower abutting the cam and positioned within the detent in the rest position; and a leaf spring, the cam follower connected to the leaf spring such that the cam follower is resiliently biased by the leaf spring into engagement with the detent such that a force applied about the pivot overcomes a biasing force provided by the leaf spring to force the cam follower out of engagement with the detent to permit movement of the mounting bracket.

2. The gate arm saver of claim 1, wherein the cam has a generally arcuate outer periphery defining an arc length, wherein the detent is positioned at a midpoint of the arc length.

3. The gate arm saver of claim 2, wherein the detent, cam follower, and a pivot axis which the pivot rotates about are aligned along a common axis in the rest position.

4. The gate arm saver of claim 3, wherein the cam follower and pivot axis remain aligned along the common axis when the cam rotates out of the rest position.

5. The gate arm saver of claim 4, wherein the cam has a radius of curvature and the pivot is pivotable about the pivot axis, and wherein an origin of the radius of curvature is not coincident with the pivot axis.

6. The gate arm saver of claim 4, wherein the cam has a radius of curvature and the pivot is pivotable about the pivot axis, and wherein an origin of the radius of curvature is not coincident with the pivot axis.

7. The gate arm saver of claim 1, wherein the leaf spring includes first and second distal ends, and wherein the pivot is positioned between the first and second distal ends.

8. The gate arm saver of claim 1, wherein the detent is a generally semi-circular notch.

9. A gate arm saver, comprising:

a mounting bracket configured to receive a gate arm, a pivot about which the mounting bracket is pivotably mounted to pivot from a rest position to a deflected position and from the deflected position to the rest position;

a cam defining a cam surface positioned outwardly about the pivot, the cam including a detent, the cam pivotable about the pivot from a rest position;

a cam follower abutting the cam surface, the cam follower positioned within the detent in the rest position; and a leaf spring, the cam follower connected to the leaf spring such that the leaf spring biases the cam follower against the cam surface to pivot the mounting bracket about the pivot to transition the mounting bracket from the deflected position to the rest position.

10. The gate arm saver of claim 9, wherein the cam has a generally arcuate outer periphery defining an arc length, the detent situated at a midpoint of the arc length.

11. The gate arm saver of claim 9, wherein the detent, the cam follower and a pivot axis which the pivot rotates about are aligned along a common axis in the rest position.

12. The gate arm saver of claim 11, wherein the cam follower and pivot axis remain aligned along the common axis when the cam rotates out of the rest position.

* * * * *